US007668480B2

(12) United States Patent
Nakayama et al.

(10) Patent No.: US 7,668,480 B2
(45) Date of Patent: Feb. 23, 2010

(54) CLEANING DEVICE FOR USE WITH IMAGE FORMING APPARATUS

(75) Inventors: Yasunori Nakayama, Aichi-ken (JP); Hidetoshi Noguchi, Tahara (JP); Satoru Shibuya, Chiryu (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 281 days.

(21) Appl. No.: 11/987,105

(22) Filed: Nov. 27, 2007

(65) Prior Publication Data

US 2008/0145118 A1 Jun. 19, 2008

(30) Foreign Application Priority Data

Nov. 30, 2006 (JP) ..... 2006-323657

(51) Int. Cl.
*G03G 15/16* (2006.01)
*G03G 15/02* (2006.01)

(52) U.S. Cl. ..... 399/101; 399/175

(58) Field of Classification Search ..... 399/101, 399/174, 175

See application file for complete search history.

(56) References Cited

U.S. PATENT DOCUMENTS 5,585,897 A * 12/1996 Takeda et al. ..... 399/175
5,805,961 A * 9/1998 Mizoe et al. ..... 399/174
7,127,191 B2 10/2006 Mori et al.

FOREIGN PATENT DOCUMENTS

JP 2005-316268 A 11/2005
JP 2006-208761 8/2006

OTHER PUBLICATIONS

Notice of Rejection in Jp 2006-323657 dated Jul. 15, 2008, and English Translation thereof.

* cited by examiner

*Primary Examiner*—Hoang Ngo
(74) *Attorney, Agent, or Firm*—Buchanan Ingersoll & Rooney PC

(57) ABSTRACT

A cleaning device for use with an electrophotographic image forming apparatus has a charging brush positioned in contact with an endless image bearing surface of a rotatable image bearing member to form a contact region in which the brush provides an electric charge with a certain polarity to toner particles passing through the contact region according to a rotation of the image bearing member, and a cleaning member positioned on a downstream side with respect to a rotational direction of the image bearing member and in contact with the image bearing surface of the image bearing member to collect the toner particles from the image bearing surface. The charging brush has a base and a number of bristles planted in the base. A contact force of the charging brush against the image bearing surface is set to be more than 0 N/m and equal to or less than 1.5 N/m.

5 Claims, 8 Drawing Sheets

*Fig. 10*

| | CONDITION 1 | CONDITION 2 | CONDITION 3 | CONDITION 4 | CONDITION 5 | CONDITION 6 | CONDITION 7 | CONDITION 8 |
|---|---|---|---|---|---|---|---|---|
| E [N/m$^2$] | $1.35\times10^9$ | $1.35\times10^9$ | $1.35\times10^9$ | $1.35\times10^9$ | $1.35\times10^9$ | $1.35\times10^9$ | $1.35\times10^9$ | $1.35\times10^9$ |
| D [NUMBER/m$^2$] | $3.72\times10^8$ | $3.72\times10^8$ | $3.72\times10^8$ | $1.86\times10^8$ | $1.86\times10^8$ | $1.86\times10^8$ | $1.86\times10^8$ | $1.24\times10^8$ |
| L [mm] | 4.8 | 4.8 | 4.8 | 4 | 4 | 5 | 5 | 5 |
| Δu [mm] | 0.1 | 0.5 | 1 | 0.5 | 1 | 0.5 | 0.3 | 0.3 |
| d [μm] | 14 | 14 | 14 | 27 | 27 | 27 | 27 | 27 |
| F [N/m] | 0.08 | 0.18 | 0.24 | 1.59 | 2.17 | 1.14 | 0.89 | 0.6 |
| RATIO [%] | 27 | 18.8 | 15.6 | 40 | 66.5 | 27.8 | 21.3 | 18.8 |

CLEANING DEVICE FOR USE WITH IMAGE FORMING APPARATUS

FIELD OF THE INVENTION

The present invention relates to a cleaning device for use with an image forming apparatus and an image forming method equipped with the cleaning device.

BACKGROUND OF THE INVENTION

An electrophotographic, monochrome image forming apparatus forms single color toner images on a photosensitive member. The toner images are transferred onto a sheet material passing through a nipping region defined between the photosensitive member and a transfer roller. Not all the toner particles are transferred onto the sheet material and a part of the toner particles remains on the photosensitive member without being transferred. In order to remove the residual toner particles from the photosensitive member, a method is proposed in which a cleaning member is provided in contact with the surface of the photosensitive member to remove the toner particles therefrom.

A variety of full color image forming apparatuses have been proposed so far. Among other things, one of the proposed electrophotographic, full color image forming apparatus is designed to transfer the toner images on the photosensitive member onto an intermediate transfer belt passing through a nipping region defined between the photosensitive member and a first transfer roller. The toner images are then transferred onto the sheet material passing through a second nipping region defined between the intermediate transfer belt and a second transfer roller. The residual toner particles on the intermediate transfer belt are removed by a cleaning member provided in contact with the photosensitive member.

Conventionally, the cleaning member for removing residual toner particles from the photosensitive member and the intermediate transfer belt is made of rubber blade in the form of elongate plate. Disadvantageously, the cleaning blade provides less cleaning ability for the spherical toner particles of smaller diameters.

To overcome this problem, JP 2004-310060 A discloses to use a rotatable cleaning brush for the cleaning member.

The cleaning device disclosed therein includes a cleaning brush mounted in contact with the outer peripheral surface of the intermediate transfer belt, and a charging brush mounted on the upstream side of the cleaning brush with respect to the rotational direction of the belt and in contact with the surface of the belt. According to the image forming apparatus, the untransferred toner particles are transported into the contact region of the belt and the charging brush by the rotation of the belt. As shown in FIG. 12, in the contact region the toner particles 100 are brought into contact with the bristles 176 of the brush 174 to have electric charge of normal polarity, for example, negative polarity. The charged toner particles are then transported into another contact region of the belt and the cleaning brush, where they are collected by the cleaning brush and removed from the peripheral surface of the belt.

In order for the untransferred toner particles to be completely removed from the belt, the toner particles are required to make good contacts with the charging brushes. For example, as shown in FIG. 13, the charging brush inappropriately forced against the belt may cause that a part of the toner particles 100 are transported through the contact region without any contact with the bristles 176 of the brush 174 when a large amount of toner particles 100 are transported into the region, which results in that the toner particles are not completely collected by the cleaning brush.

SUMMARY OF THE INVENTION

A purpose of the present invention is to provide an image forming apparatus and a cleaning device for use with the image forming apparatus, which includes a cleaning member such as brush roller and a charging brush capable of charging toner particles reliably and thereby allowing untransferred toner particles to be well collected from the image bearing member.

A cleaning device for use with an electrophotographic image forming apparatus has a charging brush positioned in contact with an endless image bearing surface of a rotatable image bearing member to form a contact region in which the brush provides an electric charge with a certain polarity to toner particles passing through the contact region according to a rotation of the image bearing member, and a cleaning member positioned on a downstream side with respect to a rotational direction of the image bearing member and in contact with the image bearing surface of the image bearing member to collect the toner particles from the image bearing surface. The charging brush has a base and a number of bristles planted in the base. A contact force of the brush against the image bearing surface is set to be more than 0 N/m and equal to or less than 1.5 N/m, which is defined by the following equation:

$$F=2yEID/L^2$$

wherein "y" is further defined by the following equation:

$$y=[L^2-(L-\Delta u)^2]^{1/2}$$

F: Contact force of charging brush
y: Deflection of bristle (m)
E: Young's modulus of bristle ($N/m^2$)
I: Geometric moment of inertia of bristle ($=\pi d^4/64$)
d: Diameter of brush
D: Density of bristles ($number/m^2$)
L: length of bristle (m)
Δu: Tip offset of contacted brush (m)

According to the present invention, the contact force of the charging brush against the image bearing surface ensures the bristles of the charging brush to reliably contact and electrically charge the toner particles passing through the contact region, which in turn ensures the cleaning brush to collect all or substantially all the toner particles passing therethrough.

BRIEF DESCRIPTION OF THE DRAWINGS

The present invention will become more fully understood from the detailed description and the accompanying drawings, wherein:

FIG. 10 is a table showing conditions of the second test;

DETAILED DESCRIPTION OF THE PREFERRED EMBODIMENTS

Figure 1:
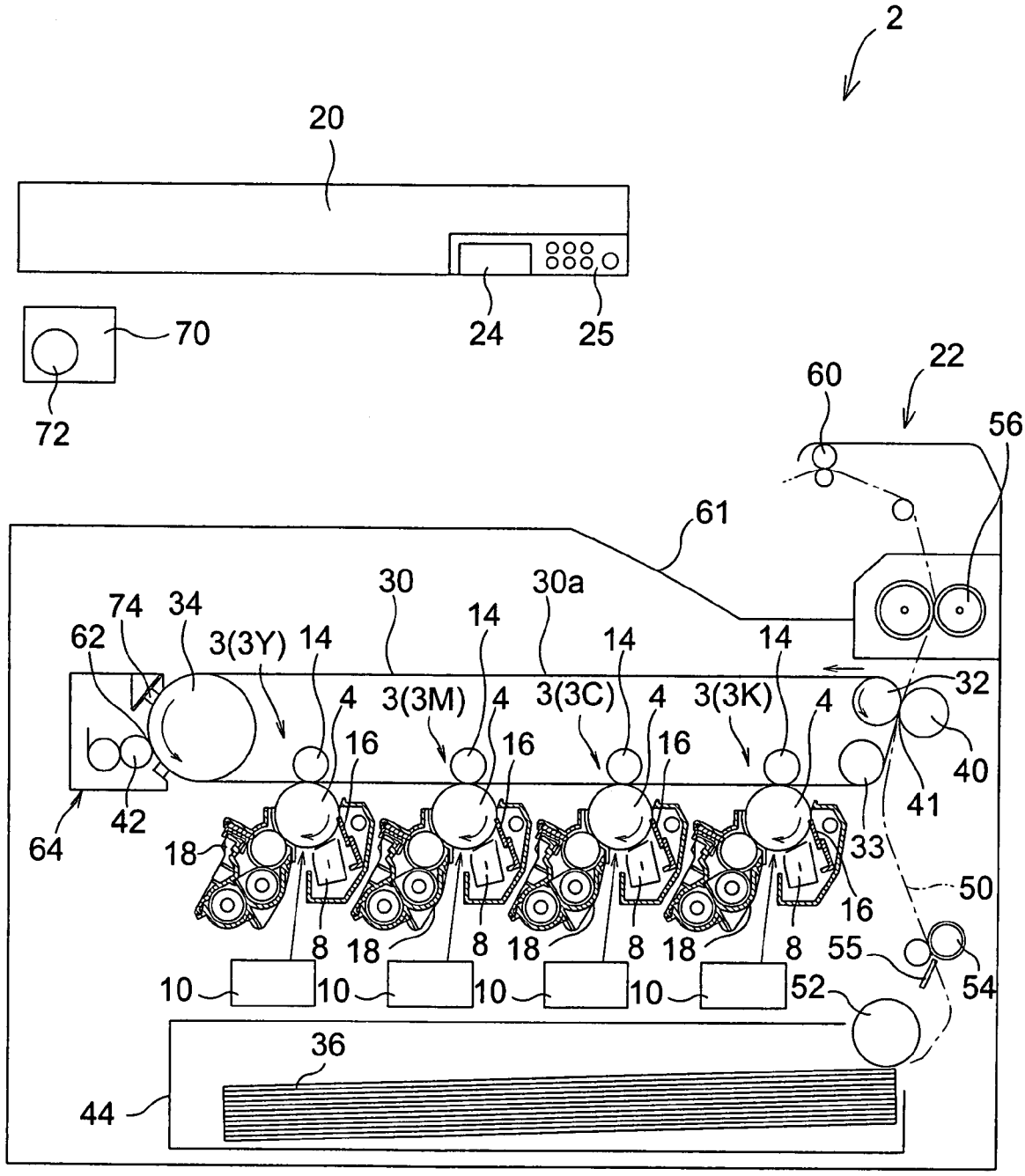
FIG. 1 is a side elevation view of an image forming apparatus according to the embodiment of the present invention.

Referring now to the drawings, several embodiments of the present invention will be described. In the following descriptions, terms indicating specific directions and positions (e.g., "up", "down", "left", "right" and other terms including any one of such terms) are used as necessary, however, the use of such terms intends to facilitate better understanding of the invention in connection with the drawings and therefore the scope of the present invention should not be limited by such terms.

FIG. 1 schematically shows an image forming apparatus 2 according to a first embodiment of the present invention. The image forming apparatus 2 is an electrophotographic image forming apparatus such as a copying machine, a printer, a facsimile, or a multifunction device with functions of such devices. Although various electrophotographic image forming apparatuses are currently available, the illustrated image forming apparatus is a so-called tandem type color image forming apparatus. The present invention may be applied not only to that image forming apparatus but also to a so-called four-cycle color image forming apparatus and a direct transfer color image forming apparatus in which the toner images on the electrostatic latent image bearing member are directly transferred onto the recording medium. In addition, the present invention is also applicable to the monochrome image forming apparatus with a single developing device.

The image forming apparatus 2 generally includes an image reading unit generally indicated by reference numeral 20 for reading a document image and a printing unit generally indicated by reference numeral 22 for printing the image. The image reading unit 20 is configured to perform a color separation of the document image into three color elements of red (R), green (G), and blue (B) by a well-known color separation technique and then generate image data of red (R), green (G), and blue (B).

The image forming apparatus may include a display device 24 for displaying various information relating to the printing and an operation panel 25 for allowing users to perform printing and various setting operations for printing.

The printing unit 22 has an image bearing member made of an endless intermediate transfer belt 30, having an endless image bearing peripheral surface 30*a*. Preferably, the belt 30 is made of a suitable material with an elevated transferring performance such as polyimide. More preferably, the belt 30 has a thickness of equal to or larger than 50 μm and equal to or less than 150 μm.

The belt 30 is entrained around a pair of rollers 32, 34 positioned on the left and right sides in the drawing. The right roller 32 is a drive roller drivingly coupled to a motor 33, so that the rotation of the motor is transmitted to the drive roller 32, which causes rotations of the belt 30 and the left roller 34 contacting the belt 30, in the counterclockwise direction.

Preferably, the peripheral surface of the drive roller 32 is made of material having a large friction coefficient such as rubber or urethane to attain an enlarged frictional force between the belt 30 and the roller 32 and thereby a reliable transmission of the drive force to the belt 30.

Preferably, a suitable tensile force is introduced to the belt 30 by the rollers 32, 34 to ensure a sufficient frictional force between the drive roller 32 and the belt 30. Preferably, the tensile force is adjusted to equal to or greater than 15 N and equal to or less than 50 N, for example.

A second transfer member made of transfer roller 40 is provided in a second transfer station adjacent the belt portion supported by the right drive roller 32 so as to nip the recording medium 36 with the belt 30. Preferably, the transfer roller 40 is made of an ion conductive roller or an electron conductive roller.

A cleaning device generally indicated by reference numeral 64 for cleaning the belt 30 is provided outside the belt portion supported by the left roller 34, which will be described in detail later.

Referring back to FIG. 1, the image forming apparatus 2 has four first transfer stations 13 where four imaging units 3 (3Y, 3M, 3C, 3K) are mounted in this order below and along the lower belt portion running from the left roller 34 to the right roller 32 for forming toner images with developers of different colors, yellow (Y), magenta (M), cyan (C), and black (K).

Each of four imaging units 3 has an electrostatic latent image bearing member made of cylindrical photosensitive member 4 mounted for rotation in the clockwise direction. A charger 8, an exposure device 10, a developing device 18, a first transfer roller 14, and a cleaning member 16 are positioned around the photosensitive member 4 in this order with respect to the rotational direction thereof.

The first transfer roller 14 is arranged within a space defined by the endless belt 30. A high voltage power supply (not shown) is connected to the transfer roller 14 so that a first transfer voltage is applied to the transfer roller 14 from the power supply during the formation of the toner images.

The printing unit 22 includes a control unit 70 for controlling various operations such as image forming operation. The printing unit 22 further includes a paper cassette 44 removably arranged in the lower part thereof so that, when printing, the recording mediums 36 stacked in the paper supply cassette 44 are fed out one by one to a transport passage 50 by the rotation of a feed roller 52 mounted on the paper cassette 44.

A registration roller 54, for transporting the paper 36 to the second transfer region 39 at a predetermined timing, is arranged adjacent the feed roller 52. A paper detector 55 for detecting the front edge of the paper 36 being transported is arranged adjacent the registration roller 54.

The transport passage 50 extends from the paper cassette 44 to a paper discharge tray 61 mounted at the upper portion of the printing unit 22 through the nipping regions defined by paired registration rollers 54, the second transfer roller 40 and the belt 30, paired fusing rollers 56, and discharging rollers 60.

Discussions will be made to a color image forming operation. In this operation, the image reading unit 20 reads the document image to generate image data of respective colors of red (R), green (G), and blue (B). The image data is transmitted to the control unit 70 where it is processed and transformed into color image data of yellow (Y), magenta (M), cyan (C), and black (K). The processed image data of yellow, magenta, cyan, and black colors is stored in an image memory 72 in the control unit 70. The image date is corrected to remove possible misregistration of the images and then converted into drive signals for causing light emission of a light source (not shown) in the exposure device 10.

Each photosensitive member 4 is rotated in the clockwise direction, during which its peripheral surface is electrically charged by the charger 8. The charged peripheral surface is exposed to light emitted from the exposure device 10 in response to the drive signal from the control unit 70, so that a corresponding electrostatic latent image is formed on the peripheral surface. The electrostatic image is then visualized by a developing material of toner particles supplied from the associated developing device 8. The toner images of respective colors of yellow, magenta, cyan, and black on respective photosensitive members 4 are transported into respective first transfer regions 15 where they are transferred onto the belt 30 in this order and superimposed thereon.

Toner particles not transferred from each image bearing member 4 to the belt 30 are transported by the rotation of the image bearing member 4 into the contact region between the photosensitive member 4 and the cleaning member 16 where it is scraped off from the peripheral surface of the photosensitive member 4. The superimposed four toner images are transported by the belt 30 into the second transfer region 39.

The recording medium 36 accommodated in the paper cassette 44 is fed out by the rotation of the supply roller 52 into the nipping region of the paired registration rollers 54 and then into the second transfer region 39 while taking a suitable timing with the toner images being transported by the belt 30 into the second transfer region 39.

Toner images are transferred onto the incremental portions of the recording medium 36 passing the second transfer region 39. The recording medium 36 is further transported to the nipping region of the paired fusing rollers 56 where the toner images are fixed to the recording medium 36 and finally transported by paired the discharge rollers 60 onto the discharge tray 61.

The toner particles without being transferred onto the recording medium and remaining on the peripheral surface of the belt 30 are removed therefrom by the cleaning device 64 which will be described below.

Figure 2:
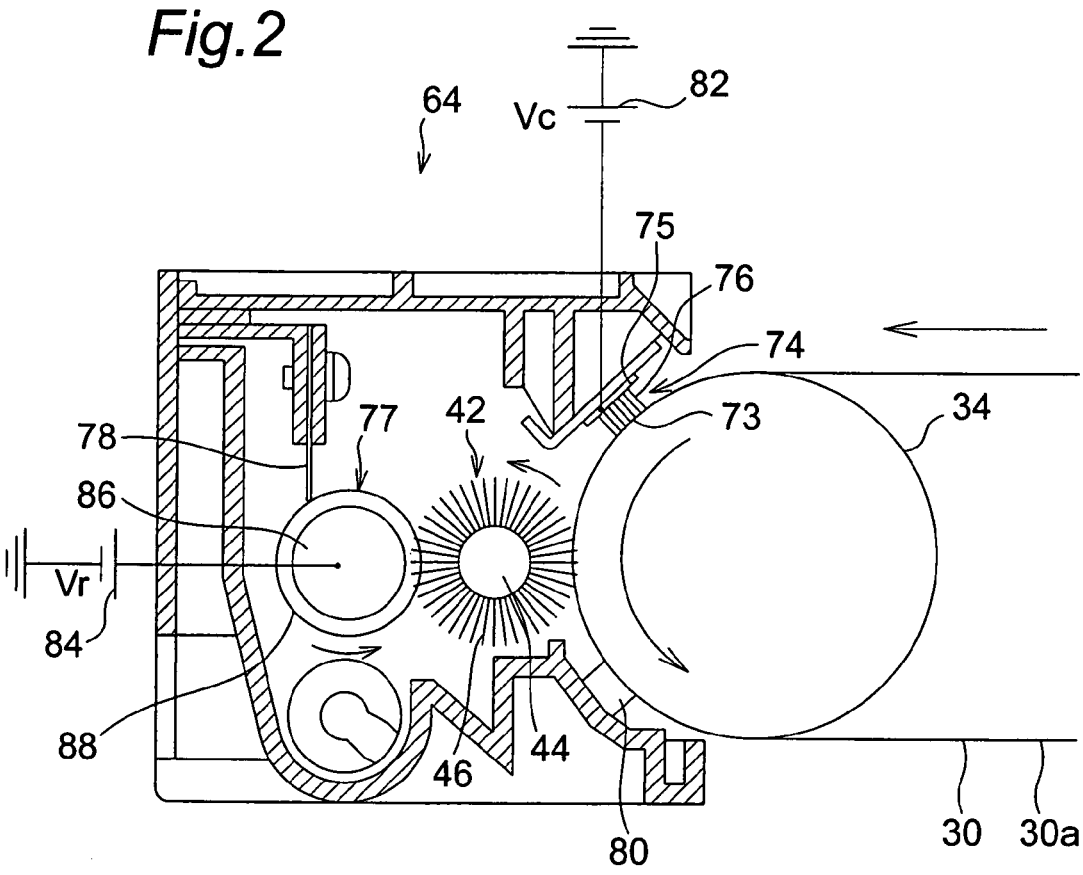
FIG. 2 is a side elevation view of a cleaning device installed in the image forming apparatus in FIG. 1.

As shown in FIG. 2, the cleaning device 64 has a charging brush 74 for electrically charging the toner particles on the peripheral surface of the belt 30 with a predetermined electric charge of negative polarity in this embodiment, a cleaning member made of brush 42 in the form of roll for removing the toner particles from the periphery of the belt 30, a collecting roller 77 for collecting toner particles from the cleaning brush 42, a scraper 78 for scraping off toner particles from the collecting roller 77, and a housing 66 for housing those members 74, 42, 77, and 78 therein.

The charging brush 74 and the cleaning brush 42 are mounted in contact with respective outer peripheral surface portions of the belt 30 supported by the roller 34.

The charging brush 74 has a base 75 in the form of plate, for example, and a number of bristles 76 planted in the base 75 so that distal ends thereof are in contact with the outer peripheral surface of the belt 30 to define a contact region or charging region 73 therebetween. The base 75 is securely mounted to a support 68 so that tips of the bristles 76 are in contact with the outer peripheral surface of the belt 30 with a biasing force or contact force F.

The base 75 is made of electrically conductive material such as metal. The bristles 76 are also made of electrically conductive material such as electrically conductive resin. Preferably, polyamide mixed with electrically conductive material is used for the bristles. Also preferably, an electric resistance per volume of the bristles 76 is designed to be $10^6$-$10^8$ Ω·m, for example.

The cleaning brush 42 in the form of roll is positioned on the downstream of the charging brush 74 with respect to the rotational direction of the belt 30 in the image forming operation. Preferably, the cleaning brush 42 is designed to rotate in a direction so that the bristles 76 travel in a direction (i.e., counterclockwise direction) opposite to the moving direction of the belt 30 at the contact region 62 between the belt 30 and the bristles 42. The contact region 62 of the brush 42 and the belt 30 defines a collecting region for collecting the untransferred toner particles from the belt 30. In this embodiment, the cleaning brush 42 has a solid or hollow cylindrical central portion 44 and a number of bristles 46 planted in the entire outer periphery of the central portion 44 and extending radially outwardly from the central portion 44. Preferably, the central portion 44 is made of metal such as iron, aluminum, and stainless and the bristles 76 are made of electrically conductive material such as conductive resin.

The collecting roller 77 is positioned in contact with the cleaning brush 42. The rotational direction of the collecting roller 77 is so determined that the peripheral portions of the cleaning brush 42 and the collecting roller 77 move in the same direction in the contact region thereof. In this embodiment, the collecting roller 77 is mounted to rotate in the clockwise direction. The collecting roller 77 is made of a hollow or solid cylindrical base 86 and a surface layer 88 covering the outer peripheral surface of the base 86. The base 86 is made of electrically conductive metal such as iron, aluminum, and stainless. The surface layer 88 is also made of electrically conductive material such as nickel plating formed by nonelectrolytic plating technique.

The scraper 78 is made of elongate plate and is positioned so that it extends substantially parallel to the axial direction of the collecting roller 77 with its distal end in contact with the outer peripheral surface of the collecting roller 77. Although not limited thereto, a suitable metal plate such as stainless plate such as SUS 304 is used for the scraper 78.

A sealing member 80, preferably made of urethane form, is so mounted that it fills a gap defined on the downstream side of the cleaning brush 42 and between the belt and the opposing housing portion to prevent toner particles from being transported into the atmosphere.

A power source 82 is connected to the base 75 of the charging brush 74 and another power source 84 is connected to the collecting roller 77. If the scraper 78 is made of electrically conductive material, it may be connected to the power source 84.

The power source 82 is designed to apply a charging voltage Vc to the charging brush 74 in order to electrically charge the toner particles being transported by the belt 30 at the contact region 73 between the belt 30 and the charging brush 74. Preferably, the charging voltage Vc has the same polarity as the properly charged toner particles. Also preferably, the voltage Vc is controlled under the constant current. For example, the power source is controlled to provide a constant current of −60 μA to the charging brush 74, which results in that the voltage Vc of −3 kV to −1 kV is applied to the charging brush 74.

This ensures that, when the power source 84 is turned on, the electric current flows from the power source 84 through the collecting roller 77 to the cleaning brush 42, so that the cleaning brush 42 is applied with the cleaning voltage Vr needed for electrically attracting and then removing toner particles from the intermediate transfer belt 30. At this moment, there exists a voltage difference between the collecting roller 77 and the cleaning brush 42 so that the voltage of the collecting roller 77 is higher than that of the cleaning brush 42. The voltage Vr has a certain polarity (negative polarity in the embodiment) that is different from that of the properly charged toner particles (negative polarity). The cleaning voltage Vr is controlled with a constant electric current of 10-20 μA, for example.

An operation for removing the untransferred toner particles from the outer periphery of the belt 30, using the cleaning device 64 so constructed, will be described in connection with a distribution of electric charge of the toner particles on the belt 30. In this embodiment, assuming that the properly charged toner particles and the charging voltage Vc have negative polarity and the cleaning voltage Vr has positive polarity.

Figure 3:
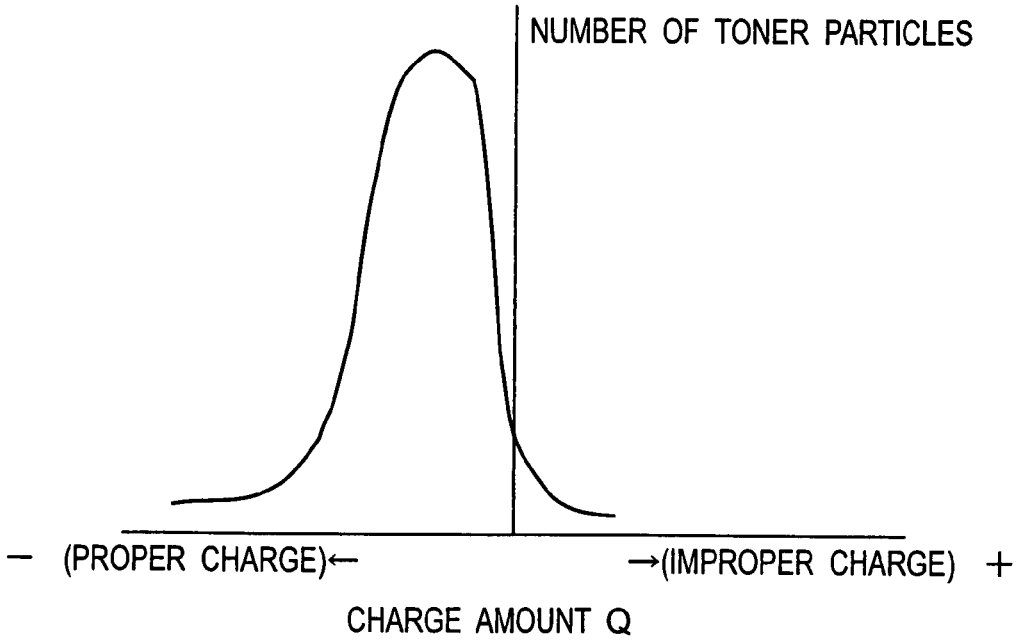
FIG. 3 is a graph showing a relationship between charge amount and the number of toner particles collected from a portion of a belt before entering into a second transfer region.
Figure 4:
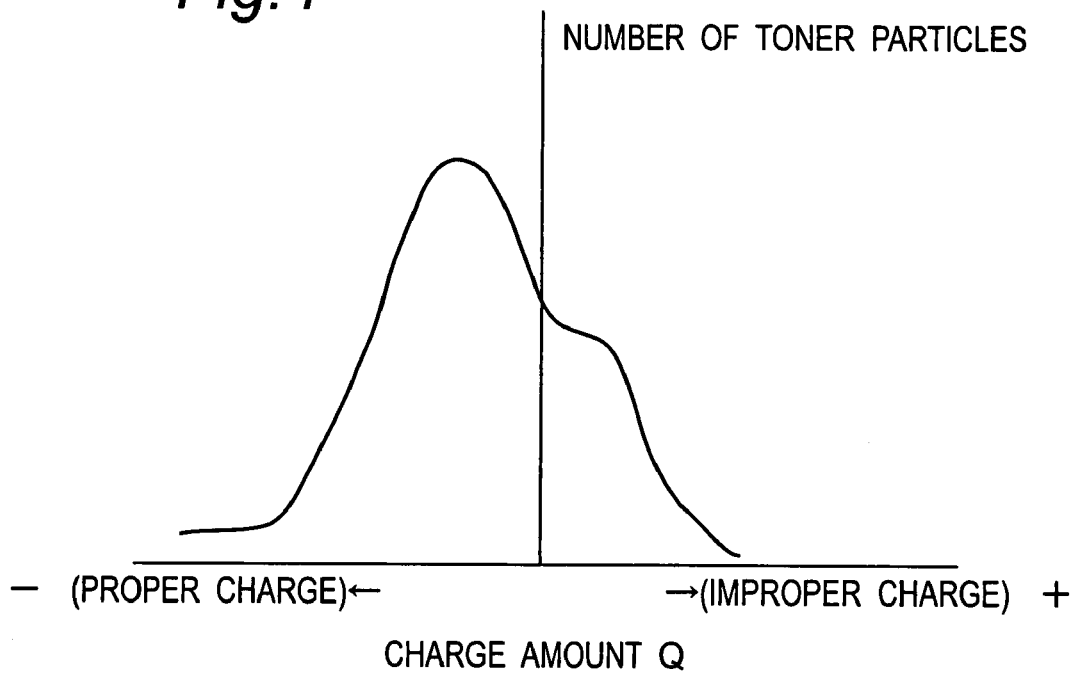
FIG. 4 is a graph showing a relationship between charge amount and the number of toner particles collected from a portion of the belt passed through the second transfer region.
Figure 5:
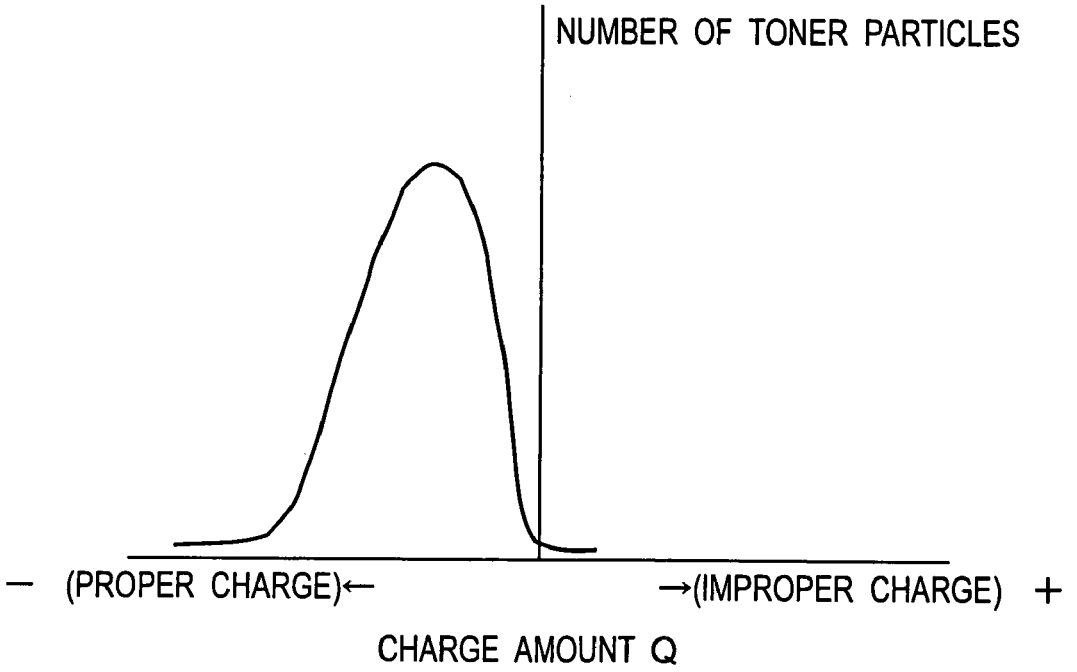
FIG. 5 is a graph showing a relationship between charge amount and the number of toner particles collected from a portion of the belt passed through a contact region of a charging brush.
Figure 6:
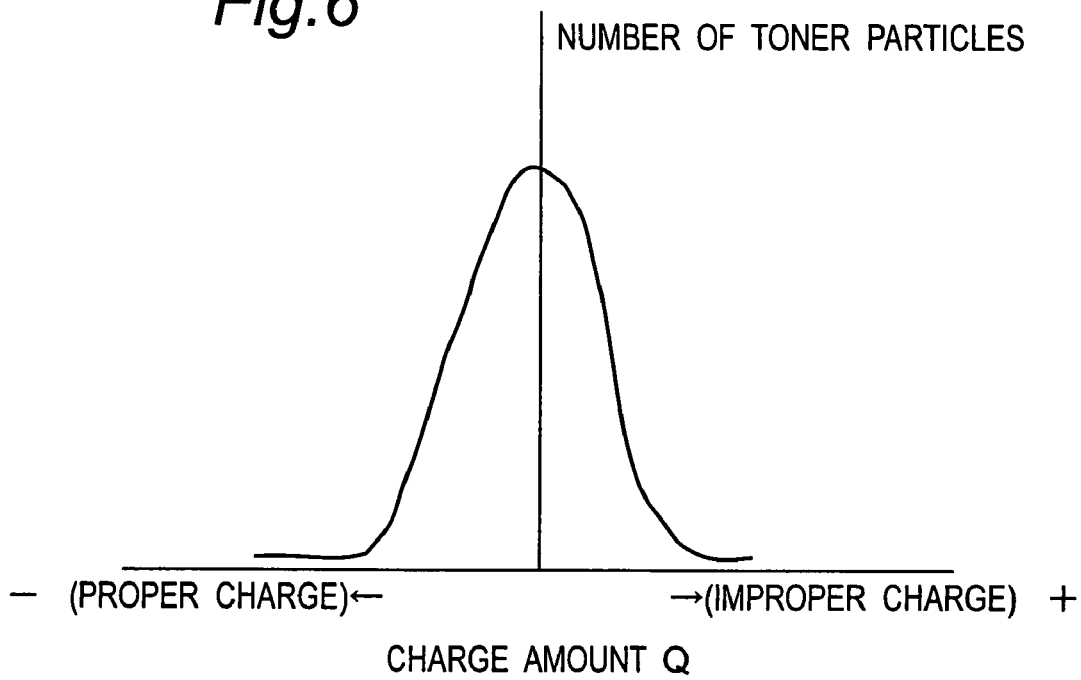
FIG. 6 is a graph showing a relationship between charge amount and the number of toner particles collected from the portion of the belt passed through the contact region of the charging brush, in which cleaning deficiency occurred in the image forming apparatus.

FIGS. 3-6 are graphs each showing a distribution of charge amount of toner particles collected at different portions of the belt 30. Specifically, FIG. 3 shows the charge amount of toner particles collected at a portion of the belt extending from the image forming units 3 to the second transfer region with respect to the rotational direction of the belt. FIG. 4 shows the charge amount of toner particles collected at a portion of the belt extending from the second transfer region to the charging brush 74 with respect to the rotational direction of the belt. FIGS. 5 and 6 show the charge amount of toner particles collected at a portion of the belt extending from the charging brush 74 to the cleaning brush 42 with respect to the rotational direction of the belt in good cleaning and defective cleaning, respectively. In each measurement, the electric charge amount was measured for each of 3,000 toner particles using the analyzer commercially available from Hosokawa Micron Co. under the tradename "E-SPART".

As can be seen from FIG. 3, most of the toner particles being transported toward the second transfer region are properly charged, i.e., negatively charged. As shown in FIG. 4, the toner particles without being transferred from the belt 30 to the recoding medium 36 at the second transfer region and then advancing toward the contact region of the belt 30 and the charging brush 74 include particles with less charged, with opposite charge and the have a wide range of charge amounts.

As shown in FIG. 5, most of the toner particles transported to the contact region, however, are brought into contact with the charging brush 74 with the negative voltage Vc and thereby charged into negative polarity. The toner particles negatively charged by the contact with the charging brush 74 are then transported into the subsequent contact region of the belt 30 and the cleaning brush 42 where they are attracted by the bristles 46 of the brush 42 to which the positive cleaning voltage Vr is applied and thereby removed from the outer periphery of the belt 30.

The toner particles collected by the cleaning brush 42 are then transported by the rotation of the brush 42 into the contact region of the brush 42 and the collecting roller 77 where they are electrically attracted to the collecting roller 77 with a higher voltage than the brush 42.

The toner particles collected by the collecting roller 77 are further transported by the rotation of the roller 77 into the contact region of the roller 77 and the scraper 78 where they are scraped off by the scraper 78.

As described above, the properly charged untransferred toner particles on the belt 30 are reliably removed from the outer periphery of the belt 30 by the contact with the cleaning brush 42 provided on the downstream side of the charging brush 74.

However, if the amount of toner particles without being charged properly is increased, not all the toner particles on the belt 30 are collected by the cleaning brush 42 and the toner particles are in part uncollected and retained on the belt 30.

Figure 13:
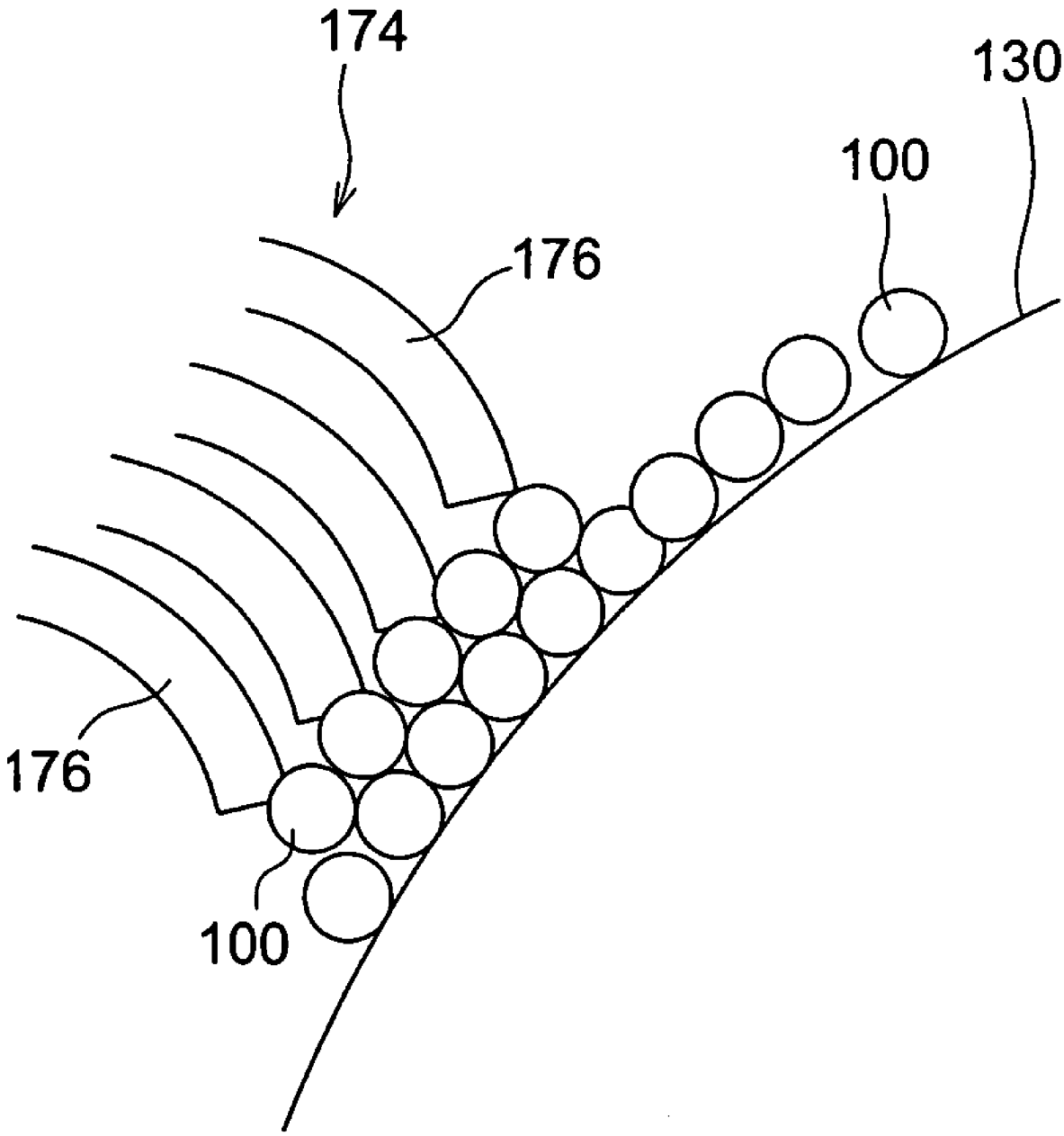
FIG. 13 is a side elevation view showing the charging brush with bristles thereof contacted improperly to the belt.

As shown in the charge amount distribution of toner particles of FIG. 6, substantially the half of the toner particles have opposite charge so that the total charge amount of the toner particles is substantially zero. One of the possible reasons is that, as shown in FIG. 13, an inappropriate arrangement of the charging brush 74 against the belt surface causes a part of the untransferred toner particles to pass through the contact region between the belt 30 and the charging brush 74 without making any or sufficient charging contact with charging brush 74.

Figure 12:
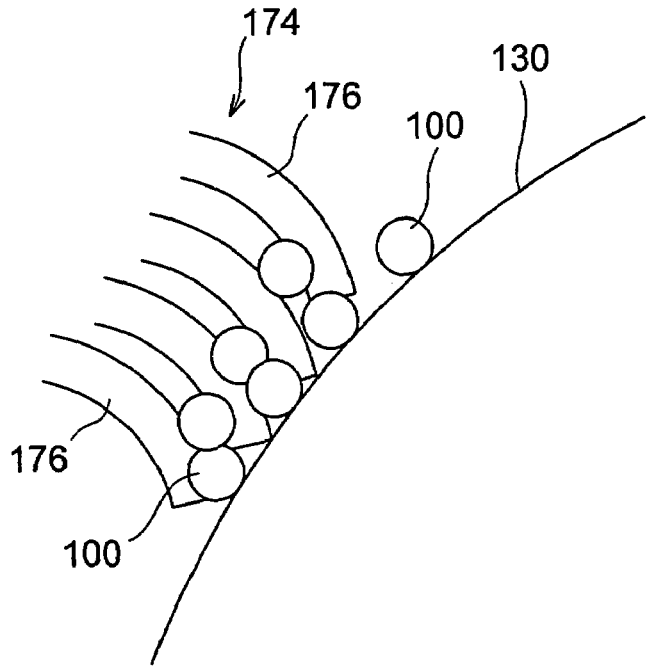
Fig.12 PRIOR ART
FIG. 12 is a side elevation view showing the charging brush with bristles thereof contacted properly to the belt.

To solve such problems, preferably the contact force of the charging brush 74 against the belt surface is determined to be larger than 0 N/m and equal to or less than 1.5 N/m to ensure that all or substantially all the toner particles make reliable charging contacts with the charging brush 74, as shown in FIG. 12. More preferably, the contact force is larger than 0 N/m and equal to or less than 1.0 N/m to enhance the durability of the brush 74.

The contact force of the charging brush will be described below. First, assuming each bristle having a circular cross section, a bending moment (Mo) is defined by the following equation:

$$Mo=2yEI/L^2$$

y: Deflection (m)

E: Young's modulus ($N/m^2$)

L: length (m)

I: Geometric moment of inertia ($=\pi d^4/64$)

Figure 7:
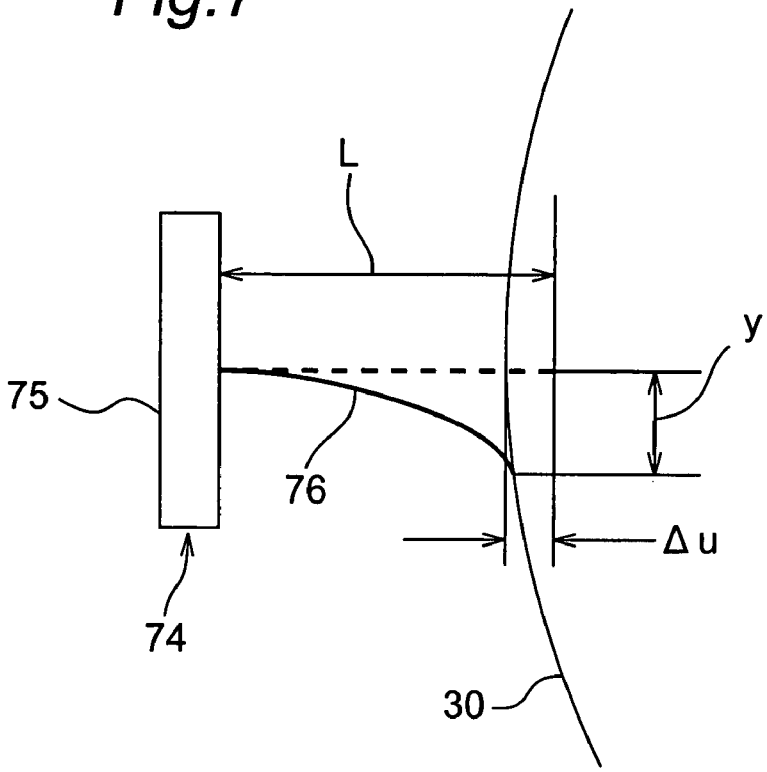
FIG. 7 is a schematic view of a bristle of the brush in which dimensions of the bristle are indicated.
Figure 8:
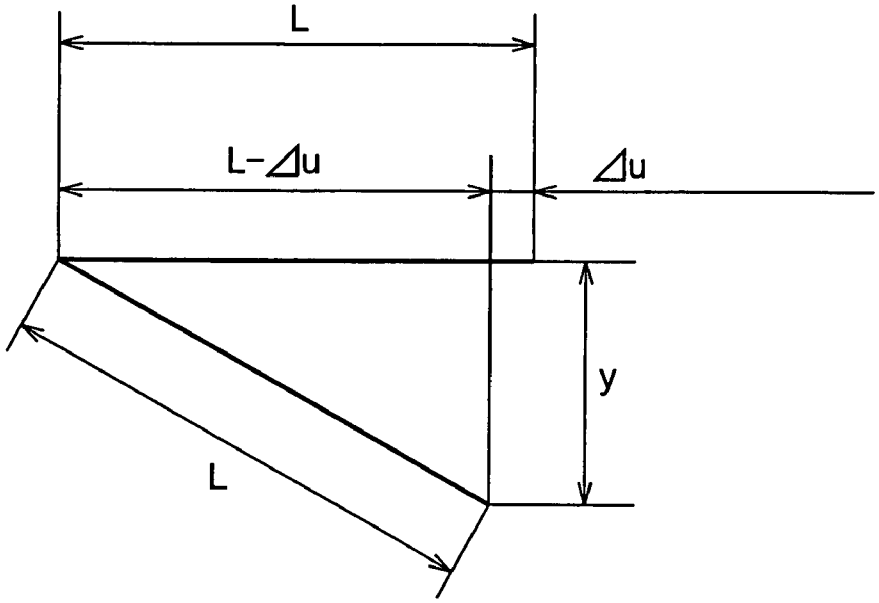
FIG. 8 is a diagram showing an approximate deflection of the bristle.

As shown in FIG. 7, although each brush 76 is curved when biasing against the belt surface, for simplicity the deflection (y) is determined approximately from the following equation:

$$y=[L^2-\Delta u)^2]^{1/2}$$

d: Diameter

D: Density ($number/m^2$)

Δu: Tip offset (m) (setback of the tip relative to the belt surface)

Then the contact force F of the brush, which is the sum of the moments, is obtained from the following equation:

$$F=MoD=2yEID/L^2$$

Tests were made to determine a relationship of between ratio of the number of positively charged toner particles to the total number of toner particles passed through the contact region of the belt and the charging brush and the cleaning performance.

In the first test, the cleaning device shown in FIG. 2 was installed in the multi-function peripheral commercially available from Konica Minolta under the tradename Bizhub C. Printed were images each made by superimposing solid magenta image and solid cyan image. The cleaning performance was evaluated in the cleaning of the untransferred toner particles remaining on the belt after the second transfer. The ratio was varied by changing the conditions of the second transfer and, in each condition, the cleaning performance was evaluated. The charging voltage to the charging brush was controlled with the constant electric current of 60 μA and the cleaning voltage to the cleaning brush was controlled with the constant electric current of 20 μA.

For obtaining the ratio, the toner particles were collected on the downstream side of the charging contact region and on the upstream side of the cleaning contact region. The amount of electric charge was measured for each of 3,000 toner particles using the analyzer commercially available from Hosokawa Micron Co. under the tradename "E-SPART", and then the ratio of the number of the positively charged toner particles to the number of all the toner particles measured (i.e., 3,000).

Cleaning performance was evaluated by measuring a color difference ΔE of the toner particles passed through the contact region of the belt and the cleaning brush. The color difference is a difference in colors of between a portion of the belt free from toner particles and a portion of the belt bearing the untransferred toner particles. Since it was difficult to measure the color difference within the interior of the housing of the multi-function peripheral, the color difference was determined by collecting untransferred toner particles by applying a transparent adhesive tape on the portion of the belt after the brush cleaning, placing the tape on a white paper, and measuring a color difference of between a portion of the tape bearing the toner particles and another portion of the tape free from toner particles. The color difference was measured by using spectrophotometric analyzer, commercially available from Konica Minolta under the tradename "CM2600d". It should be noted that less color difference represents elevated cleaning performance.

Figure 9:
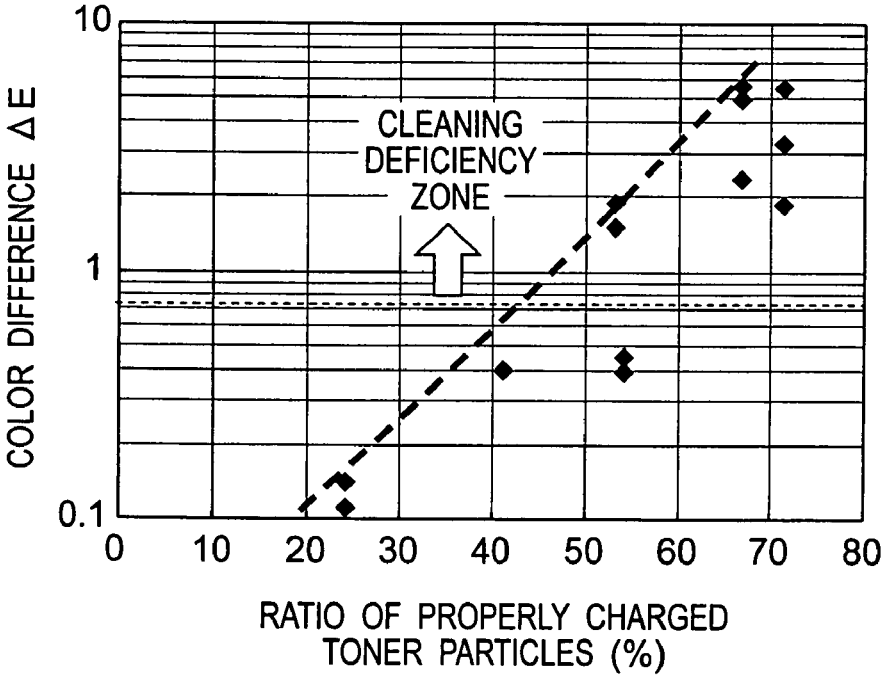
FIG. 9 is a graph showing a result of a first test conducted.

The result of the first test is indicated in FIG. 9 which shows that the color difference ΔE is in proportion to ratio of the positively charged toner particles. Assuming that a range with color difference ΔE of 0.7 or more defining a cleaning deficiency zone, it was confirmed that cleaning deficiencies would occur if the ratio of the positively charged toner particles being about 42 percent or more.

In the second test, the cleaning device shown in FIG. 2 was installed in the multi-function peripheral commercially available from Konica Minolta under the tradename Bizhub C. The contact force F was varied by changing the types and the arrangements of the charging brushes as shown in FIG. 10. Under each of the conditions 1-8 shown in FIG. 10, images each made by superimposing solid magenta image and solid cyan image were printed. The cleaning performance was evaluated in the cleaning of the untransferred toner particles remaining on the belt after the second transfer. The ratio was varied by changing the conditions of the second transfer and, in each condition, the cleaning performance was evaluated. The charging voltage to the charging brush was controlled with the constant electric current of 60 μA and the cleaning voltage to the cleaning brush was controlled with the constant electric current of 20 μA.

The ratio of the positively charged toner particles was obtained as described in the first test. It was assumed that cleaning deficiencies would occur if the ratio of the positively charged toner particles being about 42 percent or more.

Figure 11:
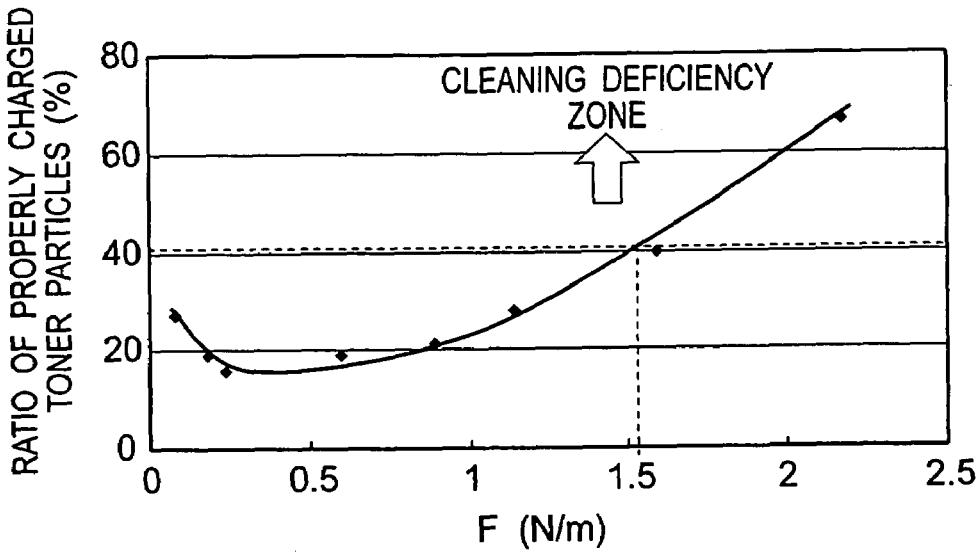
FIG. 11 is a graph showing a result of a first test conducted.

The test results were shown in FIG. 11. As can be seen from the drawing, when the positively charged toner ratio is 42%, the contact force is 1.55 N/m. Also, if the contact force is 1.5 N/m or less, the positively charged toner ratio is less than 42% and an improved cleaning performance is attained.

Although the present invention has been fully described in connection with preferred embodiments, it should be understood that the present invention is not limited thereto.

For example, although the contact force of the charging brush against the belt has been discussed, the present invention is applicable to the contact force of the charging brush against other image bearing members such as photosensitive member in the form of drum and endless belt.

What is claimed is:

1. A cleaning device for use with an electrophotographic image forming apparatus, comprising:

a charging brush positioned in contact with an endless image bearing surface of a rotatable image bearing member to form a contact region in which the brush provides an electric charge with a certain polarity to toner particles passing through the contact region according to a rotation of the image bearing member; and a cleaning member positioned on a downstream side with respect to a rotational direction of the image bearing member and in contact with the image bearing surface of the image bearing member to collect the toner particles from the image bearing surface;

wherein the charging brush has a base and a number of bristles planted in the base, and a contact force of the brush against the image bearing surface is set to be more than 0 N/m and equal to or less than 1.5 N/m, which is defined by a following equation:

$$F=2yEID/L^2$$

wherein "y" is defined by a following equation:

$$y=[L^2-(L-\Delta u)^2]^{1/2}$$

F: Contact force of charging brush y: Deflection of bristle (m)

E: Young's modulus of bristle ($N/m^2$)

I: Geometric moment of inertia of bristle ($=\pi d^4/64$)

d: Diameter of brush

D: Density of bristles ($number/m^2$)

L: length of bristle (m)

Δu: Tip offset of contacted brush (m).

2. The cleaning device of claim 1, wherein the contact force is larger than 0 N/m and equal to or less than 1.0 N/m to enhance the durability of the brush 74.

3. An image forming apparatus, comprising:

a rotatable image bearing member having an endless image bearing surface; and a cleaning device, the cleaning device having a charging brush positioned in contact with the image bearing surface to form a contact region in which the brush provides an electric charge with a certain polarity to toner particles passing through the contact region according to a rotation of the image bearing member; and a cleaning member positioned on a downstream side with respect to a rotational direction of the image bearing member and in contact with the image bearing surface of the image bearing member to collect the toner particles from the image bearing surface;

wherein the charging brush has a base and a number of bristles planted in the base, and a contact force of the brush against the image bearing surface is set to be more than 0 N/m and equal to or less than 1.5 N/m, which is defined by a following equation:

$$F=2yEID/L^2$$

wherein "y" is defined by a following equation:

$$y=[L^2-(L-\Delta u)^2]^{1/2}$$

F: Contact force of charging brush y: Deflection of bristle (m)

E: Young's modulus of bristle ($N/m^2$)

I: Geometric moment of inertia of bristle ($=\pi d^4/64$)

d: Diameter of brush

D: Density of bristles ($number/m^2$)

L: length of bristle (m)

Δu: Tip offset of contacted brush (m).

4. The image forming apparatus of claim 3, wherein the contact force is larger than 0 N/m and equal to or less than 1.0 N/m to enhance the durability of the brush 74.

5. The image forming apparatus of claim 3, further comprising:

an electrostatic latent image bearing member capable of bearing an electrostatic latent image to be visualized into a toner image made of the toner particles; and an intermediate transfer belt to which the visualized toner image is transferred, wherein the intermediate transfer belt is the rotatable image bearing member.

* * * * *